United States Patent [19]

Wood

[11] Patent Number: 4,651,997

[45] Date of Patent: Mar. 24, 1987

[54] METHOD FOR PLAYING A CARD GAME

[76] Inventor: Michael W. Wood, 1106 Willow Brook Ave., Denham Springs, La. 70726

[21] Appl. No.: 654,401

[22] Filed: Sep. 26, 1984

[51] Int. Cl.[4] ..... A63F 1/00

[52] U.S. Cl. ..... 273/274; 273/292

[58] Field of Search ..... 273/274, 292, 303, 309

[56] References Cited

U.S. PATENT DOCUMENTS

| | | | |
|---|---|---|---|
| D. 263,975 | 4/1982 | Quiroga et al. | 273/274 X |
| 3,998,462 | 12/1976 | Goott | 273/274 X |
| 4,314,700 | 2/1982 | Dylag | 273/148 R |

FOREIGN PATENT DOCUMENTS

| | | | |
|---|---|---|---|
| 991386 | 5/1965 | United Kingdom | 273/274 |

OTHER PUBLICATIONS

"Scarne's Encyclopedia of Games", by John Scarne, publ. by Harper & Row, New York, copyright 1973, pp. 279, 297–302, 313 ,327 and 328 relied on.

*Primary Examiner*—Anton O. Oechsle

*Attorney, Agent, or Firm*—William David Kiesel; Robert C. Tucker

[57] ABSTRACT

A method for playing a card game is provided, utilizing at least four standard decks of playing cards ranked from low to high in the order of 2, 3, 4, 5, 6, 7, 8, 9, 10, Jack, Queen, King and Ace and a playing surface comprising the steps of a player placing a wager, a dealer dealing two cards face up to the player, the player placing a second wager and the dealer then dealing a third card face up to the same player, wherein if the third card is of a rank between the first two cards, the dealer pays the player an equal amount on the first and second wagers according to odds posted on the playing surface. If the first two cards dealt are of equal rank, the player wins automatically according to posted odds. If the first two cards dealt are of equal rank and that rank is Jack, Queen, King or Ace, the player automatically wins according to posted odds and is dealt a third card which, if of equal rank with the first two cards, increases the player's winnings without risk, according to posted odds.

3 Claims, 1 Drawing Figure

METHOD FOR PLAYING A CARD GAME

BACKGROUND OF THE INVENTION

In casino establishments there are three major criteria for an acceptable game: (1) the game must be entertaining to play, (2) the game must appear to have reasonable odds in favor of the player and (3) the game must actually have unvarying odds in favor of the casino or dealer, but must also meet requirements of regulatory agencies. Relatively few card game procedures meet these criteria due to the difficulty in achieving the third criteria while retaining the first two. A recent attempt was made to introduce a card game known as "Middles" or "In Between" to the casino industry. This game resembles that of the applicant herein. However, the game was unable to meet the above criteria and was not successful. Another game, "Yablon", is also known, which has as its object the drawing of a card ranked between the ranks of two previously dealt cards. "Yablon" is played similar to poker with cards being dealt face down and the players playing against each other. In casino play, it is desirable for a player to only play against himself rather than against a hand held by the dealer or another player.

SUMMARY OF THE INVENTION

Therefore, it is an object of this invention to provide a card game which is entertaining to play.

Another object of this invention is to provide such a card game which appears to have reasonable odds in favor of the player.

Still another object of this invention is to provide such a card game in which the odds of winning are actually unvarying in favor of the casino or dealer, but also meet the requirements of regulatory agencies.

Still another object of this invention is provide such a card game in which a player plays against himself rather than against a hand held by the dealer or another player.

Still further objects and advantages of this invention shall become apparent from the ensuing descriptions of the invention.

Accordingly, a card game is provided, utilizing a master deck including at least four 52-card decks of standard playing cards, in which at least one player places a first wager and then a dealer deals two cards face up to the player. If the cards are of equal rank the player wins an amount according to odds posted on the playing surface. If the cards are of consecutive rank the player loses an amount equal to his first wager. Otherwise, the player is allowed to place a second wager of an amount less than or equal to his first wager. Then the dealer deals a third card face up to the player. If the third card is of a rank between the first two cards the player receives an equal amount on his first and second wagers according to posted odds. If the first two cards dealt are of equal rank and that rank is Jack, Queen, King or Ace, the player automatically wins according to posted odds and is dealt a third card which, if of equal rank with the first two cards, increases the player's winnings without risk, according to posted odds.

PREFERRED EMBODIMENTS OF THE INVENTION

Figure 1:
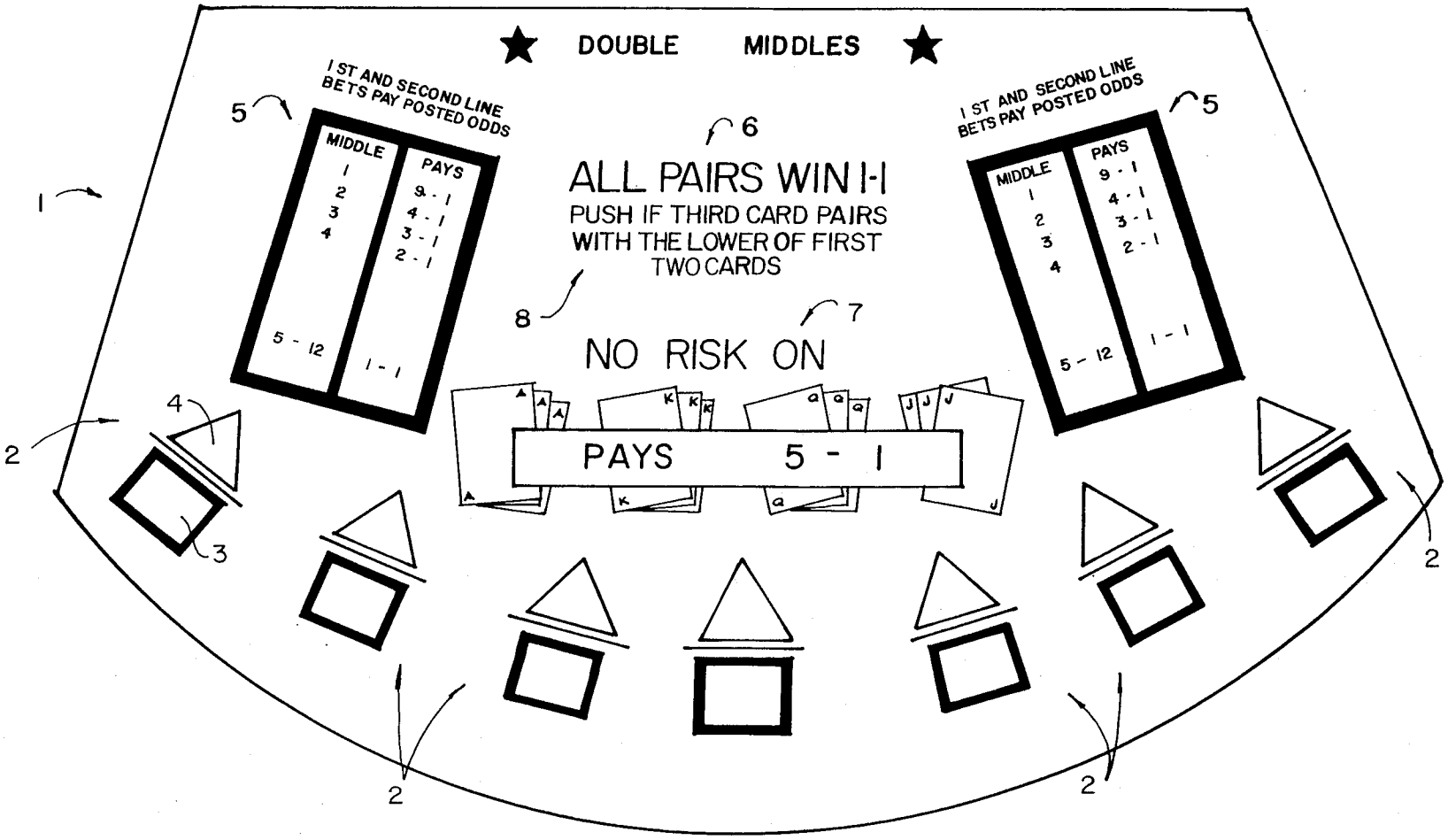
FIG. 1 is a diagram of a typical playing surface layout for the card game described by this invention.

As shown in FIG. 1, a typical playing surface 1 is marked for play. The playing surface 1 is provided with playing areas 2 for several players. Each playing area 2 is divided into a first wager area 3 and a second wager area 4. Information regarding winning possibilities is posted on the playing surface 1. An example of such information can be found by referring to the posted odds in chart 5.

The game can be played with one or more players. At least four standard 52-card decks of playing cards are combined into a master deck and used in the game. A dealer deals cards to each player face up and pays winnings according to the posted odds. A player does not play against the dealer or other players. He plays only against himself.

The game begins with each player placing a first wager in the first wager area 3. The dealer then deals two cards face-up to each player. The cards are ranked, from low to high, in the order of 2, 3, 4, 5, 6, 7, 8, 9, 10, Jack, Queen, King and Ace. If the two cards dealt are of equal rank the game is over and the player is an automatic winner of an amount according to posted odds for pairs 6. If the two cards dealt are of equal rank and are Jacks, Queens, Kings or Aces, a third card is dealt to the player. If the third card is of equal rank with the first two, the player automatically wins according to increased posted odds 7 without further risk. The possibility of winning without risk increases the game's entertainment value and attractiveness.

If the two cards originally dealt are not of equal rank, other possibilities of play arise. If the two cards are of consecutive rank the game is over and the player loses his first wager. If the two cards are not of consecutive rank, play continues. The player is then allowed to place a second wager up to the amount of the first wager in the second wager area 4. A third card is then dealt face up to the player. If the third card is of a rank between the first two cards, the player is a winner, ending the game. The player wins an equal amount on his first and second wagers according to posted odds 5. It is usually undesirable to post odds such that as the gap between the ranks of the first two cards increases, the amount of winnings possible decreases. If the third card is not of a rank between the first two cards, the game is over and the player loses his first and second wagers. In a preferred embodiment of the invention, a "push" is declared if the third card dealt is equal in rank to one of the first two cards dealt. The casino must determine whether the "push" will occur when the third card pairs up with the lower or the higher of the first two cards. Such a determination should be posted, as noted at 8, on the playing surface 1. When a "push" occurs, the game is ended without a winner and the player's wagers are returned to him.

Examples of possible game results using the playing surface and posted odds shown in FIG. 1, are illustrated by the following table:

| | 1st Card | 2nd Card | 3rd Card | Results |
|---|---|---|---|---|
| Playing Card Rank | 4 | 9 | 6 | Player wins first wager 2:1 and second wager 2:1 second wager 2:1. |
| Playing Card Rank | 4 | 5 | None | Player loses first and only wager. |

-continued

| | 1st Card | 2nd Card | 3rd Card | Results |
|---|---|---|---|---|
| Playing Card Rank | 6 | 6 | None | Player wins first and only wager 1:1. |
| Playing Card Rank | Jack | Jack | 4 | Player wins first and only wager 1:1. |
| Playing Card Rank | King | King | King | Player wins first and only wager 5:1. |
| Playing Card Rank | 7 | 10 | 4 | Player loses first and second wagers. |
| Playing Card Rank | 4 | Jack | Jack | Player loses first and second wagers. |
| Playing Card Rank | 4 | Jack | 4 | Player's wagers are returned - no winner. |

When the game is played according to the procedure of this invention, it meets the difficult criteria of a successful casino game. There are, of course, many alternate embodiments not specifically described but which are intended to be included within the scope of this invention as defined by the following claims.

I claim:

1. A method of playing a card game utilizing a master deck including at least four 52-card decks of standard playing cards which are ranked from low to high in the order of 2, 3, 4, 5, 6, 7, 8, 9, 10, Jack, Queen, King and Ace, and a playing surface, comprising the steps of:

(a) at least one player placing a first wager into a first marked space on a playing surface;

(b) a dealer dealing to said player two cards face up on said playing surface;

(c) if said two cards are of equal rank, said dealer paying said player an amount according to first predetermined odds posted on said playing surface and ending said game if said rank is not Jack, Queen, King or Ace;

(d) if said two cards are of equal rank and said rank is Jack, Queen, King or Ace, said dealer dealing a third card to player wherein:

(i) is said third card is of equal rank with said two cards, said dealer paying said player an amount according to said second predetermined odds posted on said playing surface ending said game; or (ii) if said third card is of a different rank from said two cards, said dealer paying said player according to said first predetermined odds posted on said playing surface ending said game;

(e) if said two cards are not of consecutive rank or of equal rank, said player placing a second wager of an amount up to the amount of said first wager into a second marked space on said playing surface;

(f) then said dealer dealing said third card to said player;

(g) if said third card is of a rank which is not between the ranks of said two cards, said player paying said dealer an amount equal to said first and second wagers ended said game; and (h) if said third card is of a rank between the ranks of said two cards, said dealer paying said player an equal amount on said first and second wagers according to a set of third predetermined odds posted on said playing surface ending said game, said third predetermined odds varying in accordance with the difference in rank between said two cards.

2. A method for playing a card game according to claim 1, further comprising the step of:

(i) said dealer returning said first and second wagers to said player ending said game if said third card dealt in step (f) is of a rank equal to the rank of one of said two cards, said rank beging determined as the higher or lower of said two cards as posted on said playing surface.

3. A method according to claim 1 wherein said third predetermined odds increase as the number of ranks between the ranks of said two cards decreases.

* * * * *